US005508484A

United States Patent [19]

Chen

[11] Patent Number: 5,508,484

[45] Date of Patent: Apr. 16, 1996

[54] CEILING FAN CONTROL SWITCH BOX

[75] Inventor: S. W. Chen, Taichung Hsien, Taiwan

[73] Assignee: Air Cool Industrial Co., Ltd., Taichung Hsien, Taiwan

[21] Appl. No.: 237,212

[22] Filed: May 3, 1994

[51] Int. Cl.[6] ..... H01H 9/04

[52] U.S. Cl. ..... 200/302.1; 200/543; 200/302.3; 138/96 T

[58] Field of Search ..... 200/302.1, 302.3, 200/543, 544, 545, 546, 223, 373; 138/96 R, 96 T

[56] References Cited

U.S. PATENT DOCUMENTS 2,611,061 9/1952 Richardson et al. ..... 200/543

2,659,791 11/1953 Dickinson ..... 200/543

2,984,725 5/1961 Hubbell et al. ..... 200/302.3

*Primary Examiner*—Henry J. Recla

*Assistant Examiner*—David J. Walczak

*Attorney, Agent, or Firm*—Birch, Stewart, Kolasch & Birch

[57] ABSTRACT

A ceiling fan control switch box, which includes a casing, a pull switch received inside the casing and having a hollow screw rod extended out of a wire hole on the casing and fixed in place by a screw nut, an angle pipe having raised ribs on the inside fitting around the screw nut to stop water from entering the wire hole, a fan motor forward/backward switch received inside the casing and having a switching lever extended out of an opening on the casing, and a flexible water sealing cap fastened to the casing and mounted around the switching lever to stop water from entering the casing through the opening without affecting the switching operation of the switching lever.

3 Claims, 4 Drawing Sheets

CEILING FAN CONTROL SWITCH BOX

TECHNICAL FIELD

The present invention relates to ceiling fans, and more particularly relates to a water-tight control switch box for a ceiling fan.

BACKGROUND OF THE INVENTION

The control switch box of a regular ceiling fan, as shown in FIG. 1, is generally comprised of a casing covered by a bottom cover, a pull switch received inside the casing and having a hollow screw rod extended out of a wire hole on the casing and fixed in place by a screw nut permitting the pull wire of the pull switch to be guided out of the casing and the screw nut through the wire hole, and a forward/backward switch fastened to the inside wall of the casing by screws and having a switching lever extended out of an opening on the casing for controlling the revolving direction of the fan motor. This structure of a ceiling fan control switch box is functional however, it is not suitable for use outdoors because rain water may enter the casing through the wire hole or the opening on the casing, causing damage to the electric circuit.

SUMMARY OF THE INVENTION

The present invention has been accomplished to provide a ceiling fan control switch box which eliminates the aforesaid problem. According to one aspect of the present invention, the ceiling fan control switch box comprises a casing covered with a bottom cover, a pull switch fastened to the casing on the inside by a screw nut and having a pull wire extended out of the casing and the screw nut through a wire hole on the casing, a forward/backward switch mounted inside the casing and having a switch lever extended out of an opening on the casing and switched to control the revolving direction of the fan motor of the ceiling fan, an angle pipe fastened to the screw nut to guide the pull wire, the angle pipe having a plurality of ribs raised around an inside wall thereof and fitted around the screw nut and stopped against the casing to stop water from entering the wire hole, and a water sealing cap fastened to the casing and mounted around the switching lever of the forward/backward switch to stop water from entering the casing through the opening.

Further scope of applicability of the present invention will become apparent from the detailed description given hereinafter. However, it should be understood that detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 3:
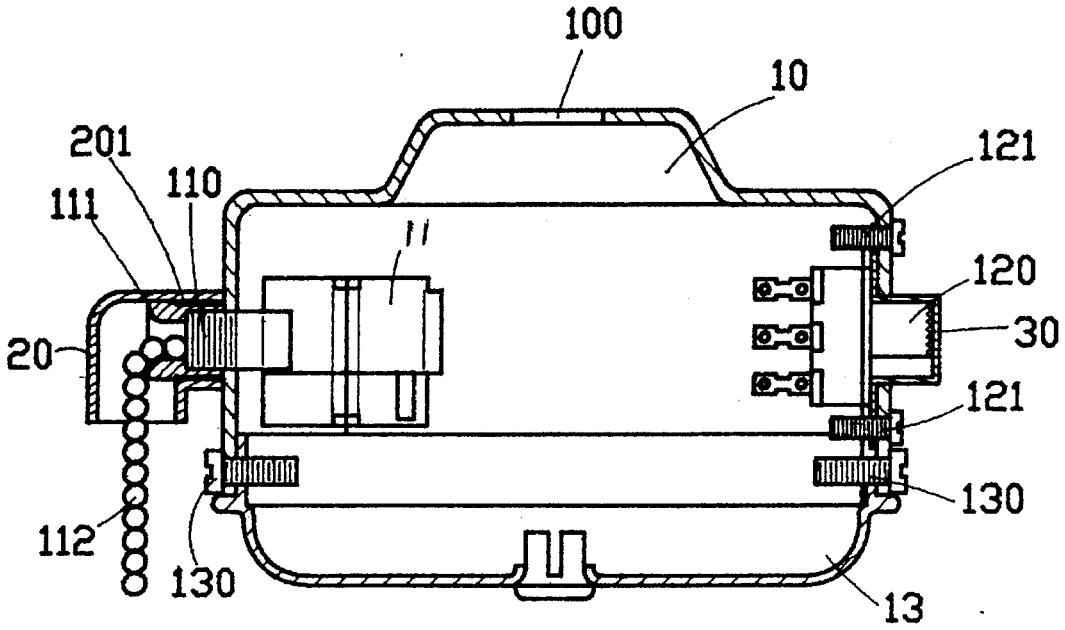
FIG. 3 is a side view in section of the ceiling fan control switch box shown in FIG. 2.
Figure 1:
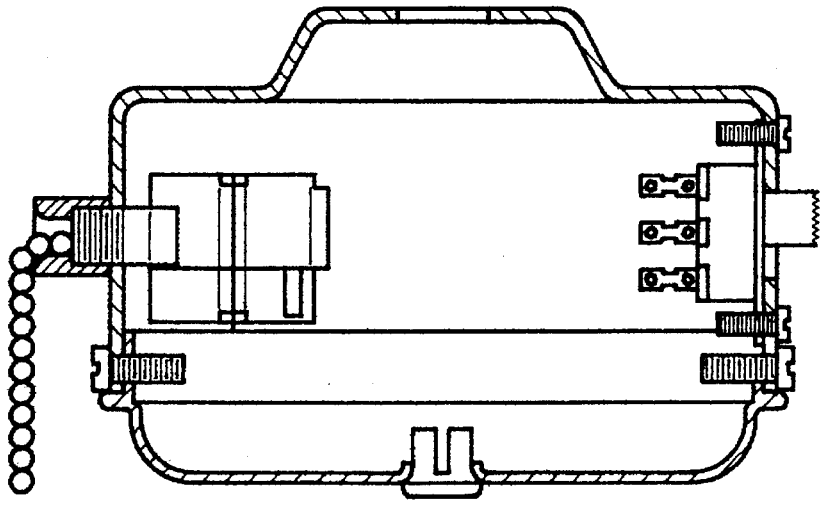
FIG.1 PRIOR ART
FIG. 1 is a side view in section of a ceiling fan control switch box according to the prior art.
Figure 2:
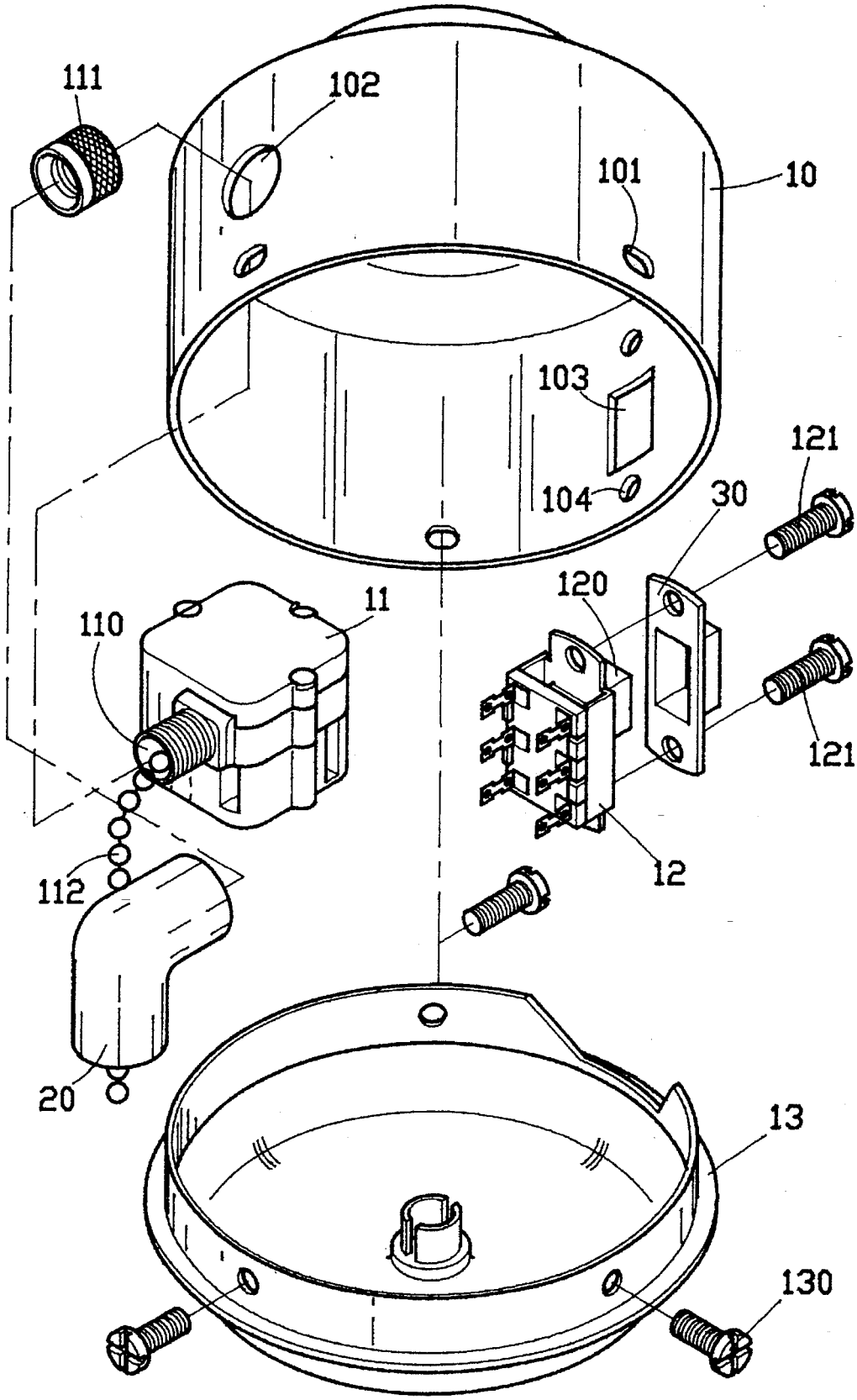
FIG. 2 is an exploded view of a ceiling fan control switch box according to the present invention.
Figure 4:
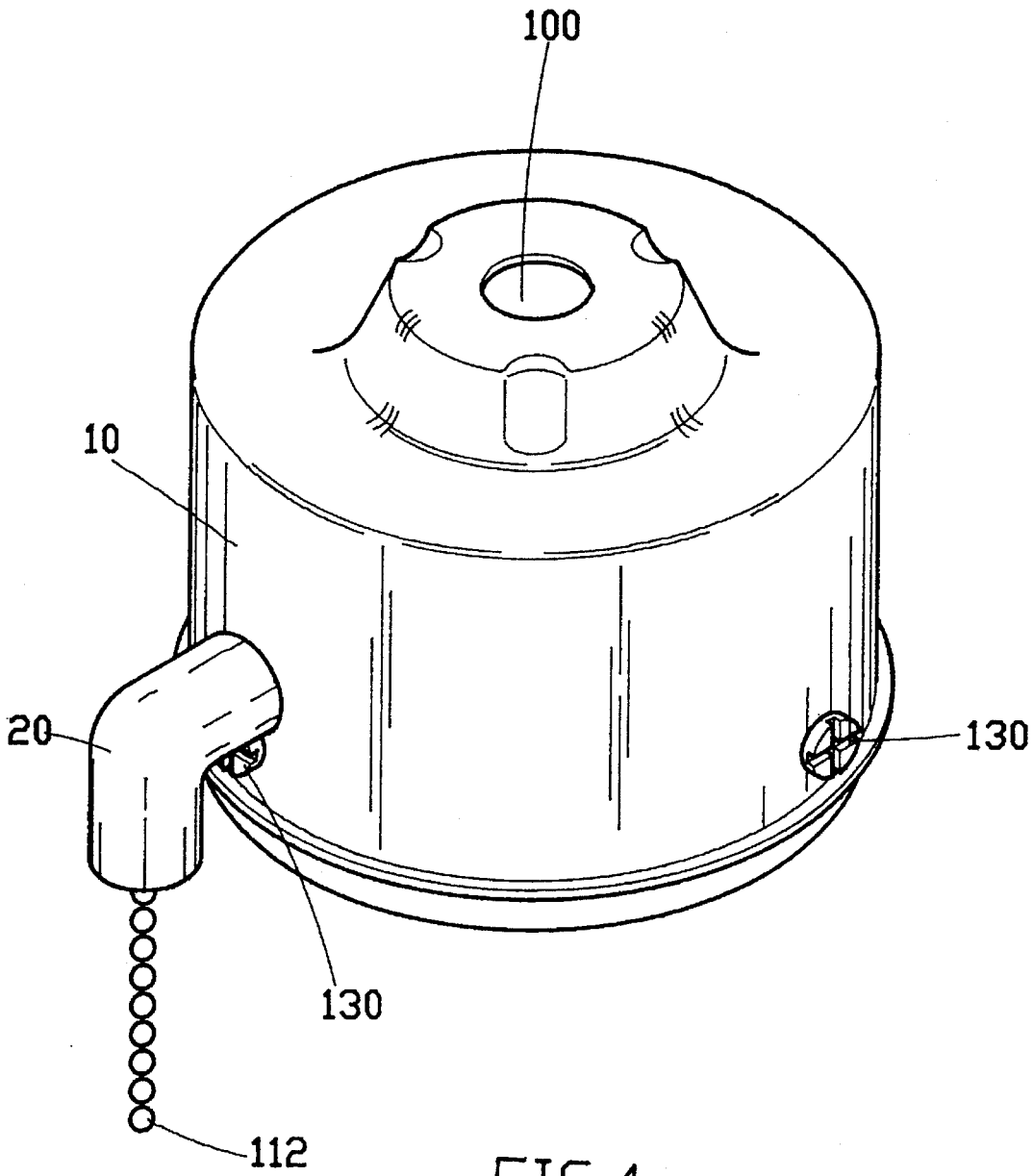
FIG. 4 is an elevational view of the ceiling fan control switch box shown in FIG. 2.
Figure 5:
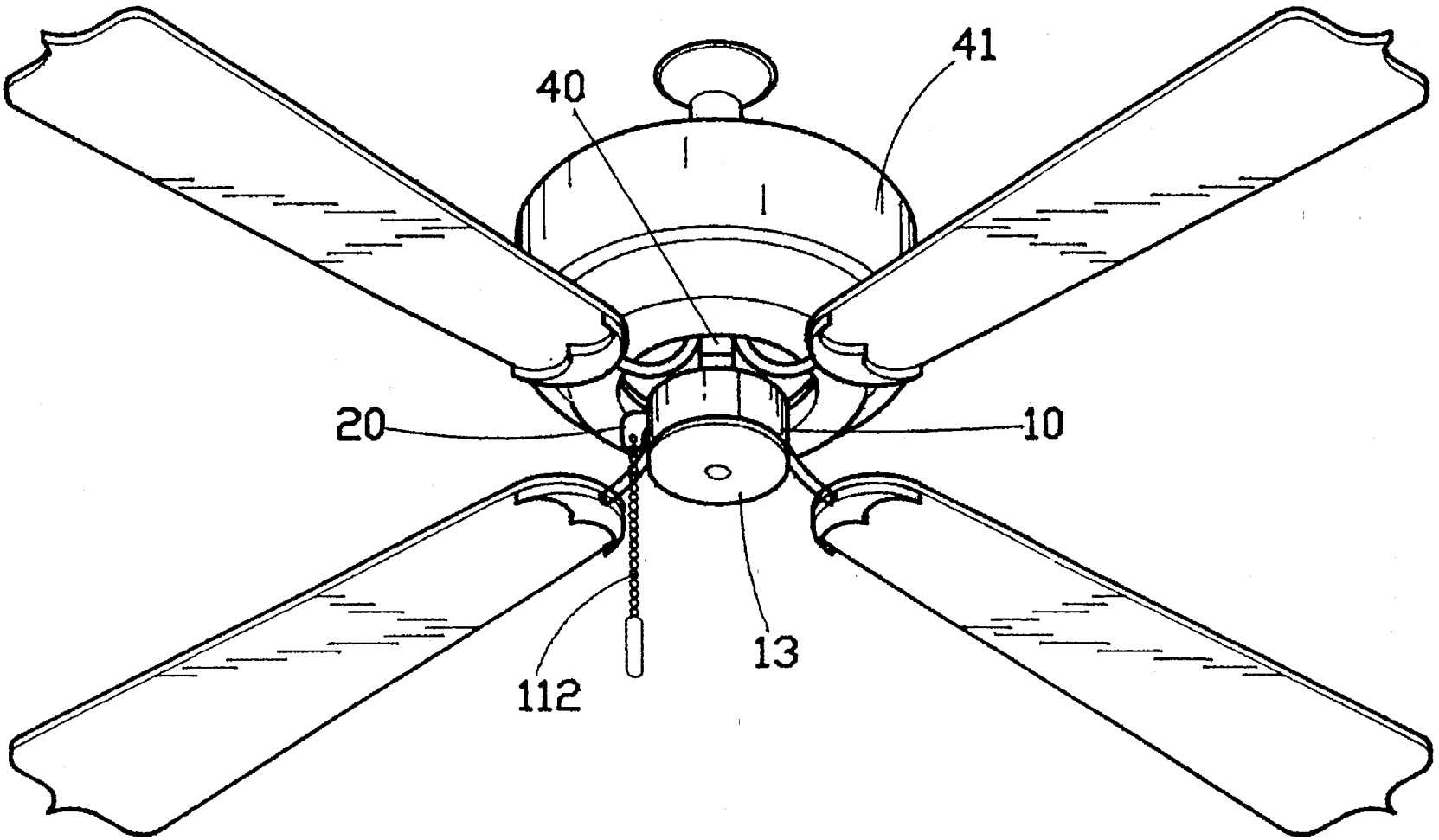
FIG. 5 is an installed view showing the present invention installed in a ceiling fan.

Referring to FIGS. 2, 3, 4, and 5, a ceiling fan control switch box in accordance with the present invention is generally comprised of a casing 10, a pull switch 11, a forward/backward switch 12, a bottom cover 13, an angle pipe 20, and a water sealing cap 30.

The casing 10 has a circular shape with a top center hole 100 for mounting the shaft 40 of the ceiling fan for allowing electricity to be transmitted to the fan motor 41 of the ceiling fan through electric wires (not shown) and a plurality of mounting holes 101 around the periphery near the bottom thereof for mounting the bottom cover 13 by screws 130. The pull switch 11 is disposed inside the casing 10, having a hollow screw rod 110 extended out of a circular wire hole 102 on the casing 10 and then fixed in place by a screw nut 111. The angle pipe 20 is fastened to the screw nut 111 permitting the pull wire 112 of the pull switch 11 to be suspended outside the fan motor 41. The forward/backward switch 12 is disposed inside the casing 10 with its switching lever 120 extended out of an opening 103 on the casing 10 and then covered by the water sealing cap 30 permitting the forward/backward switch 12 and the water sealing cap 30 to be fastened to mounting holes 104 on the casing 10 at two opposite sides by screws 121.

Referring to FIGS. 2 and 3 again, the outside wall of the screw nut 111 is embossed with crossed strips; the angle pipe 20 has a plurality of ribs 201 on the inside wall thereof. When the angle pipe 20 is mounted around the screw nut 111, the angle pipe 20 and the screw nut 111 becomes firmly retained together, permitting the angle pipe 20 to stop with its one end against the outside wall of the casing 10. The ribs 201 are positioned around the screw nut 111. Therefore, water is prohibited from entering the casing 10 through the circular wire hole 102 and can be guided to flow downwards along the periphery of the angle pipe 20. Furthermore, because the water sealing cap 30 is fastened to the casing 10 on the outside and covered around the switching lever 120 of the forward/backward switch 12, water is prohibited from entering the casing 10 through the opening 103 to damage the forward/backward switch 12. The water sealing cap 30 is made of rubber or flexible water-proof material, therefore it does not hinder the switching of the switching lever 120. The water-proof material of water sealing cap 30 can be deformed for all allowing switching lever 120 to be switched in either direction.

Referring to FIG. 5 again, when installed, the control switch box is disposed beneath the fan motor 41. Because the top center hole 100 is fastened to the shaft 40 and sealed, water is prohibited from entering the casing 10 through the top center hole 100. Therefore, when the ceiling fan is installed outdoors, no rain water can enter the casing 10 to damage the electric circuit.

While only one embodiment of the present invention has been shown and described, it will be understood that various modifications and changes could be made without departing from the spirit and scope of the invention. For example, sealing rubbers may be around either hole on the casing to seal the gaps.

What is claimed is:

1. A ceiling fan control switch box comprising a casing covered with a bottom cover, a pull switch fastened to the casing on an inside thereof by a screw nut and having a pull wire extended out of said casing and said screw nut through a wire hole on said casing, a forward/backward switch mounted inside said casing and having a switch lever extended out of an opening on said casing and being adapted to be switched to control a revolving direction of a fan motor of a ceiling fan, an angled pipe fastened to said screw nut for guiding said pull wire, said angled pipe having at least one rib on an inside wall thereof and fitted on said screw nut and against an exterior of said casing to enable said angled pipe to stop water from entering said wire hole and a water sealing cap fastened to said casing and mounted around said switch lever of said forward/backward switch to stop water from entering said opening.

2. The ceiling fan control switch box of claim 1, wherein a plurality of ribs are provided on an inside wall of the angled pipe and positioned around said screw nut.

3. The ceiling fan control switch box of claim 1, wherein said water sealing cap is made of flexible, water-proof material that can be deformed for allowing said switching lever to be switched in either direction.

* * * * *